US007695318B1

(12) United States Patent
Wang et al.

(10) Patent No.: US 7,695,318 B1
(45) Date of Patent: Apr. 13, 2010

(54) PLUG CONNECTOR

(75) Inventors: Fang-Hong Wang, Hsin-Tien (TW); Shu-Lin Duan, Hsin-Tien (TW); Ching-Tien Chen, Hsin-Tien (TW); Pin-Yuan Hou, Hsin-Tien (TW); Wen-Chih Ko, Hsin-Tien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 12/398,207

(22) Filed: Mar. 5, 2009

(30) Foreign Application Priority Data

Dec. 9, 2008 (TW) ..... 97222049 U

(51) Int. Cl.
*H01R 13/648* (2006.01)

(52) U.S. Cl. ..... 439/607.01; 439/660

(58) Field of Classification Search ..... 439/660, 439/607.01

See application file for complete search history.

(56) References Cited

U.S. PATENT DOCUMENTS

| | | | | |
|---|---|---|---|---|
| 5,906,518 | A * | 5/1999 | Sun | 439/660 |
| 6,609,922 | B2 * | 8/2003 | Torii | 439/247 |
| 6,755,689 | B2 * | 6/2004 | Zhang et al. | 439/607.01 |
| 6,790,055 | B1 * | 9/2004 | Shiu et al. | 439/79 |
| 6,935,899 | B2 * | 8/2005 | Lee | 439/630 |
| 7,517,253 | B1 * | 4/2009 | Chiang | 439/660 |
| 7,563,140 | B1 * | 7/2009 | Wan et al. | 439/660 |
| 7,572,146 | B1 * | 8/2009 | Chiang | 439/660 |

* cited by examiner

*Primary Examiner*—Truc T Nguyen
(74) *Attorney, Agent, or Firm*—Rabin & Berdo, P.C.

(57) ABSTRACT

A plug connector has an insulative housing, a plurality of first terminals, a plurality of second terminals and a positioning bracket. The terminals are mounted in the insulative housing and each terminal has a soldering portion. The positioning bracket is mounted on the insulative housing and has a positioning protrusion having a top surface and a bottom surface respectively holding the soldering portions on two levels. The soldering portions are arranged in two levels to facilitate soldering wires to the soldering portions.

11 Claims, 12 Drawing Sheets

PLUG CONNECTOR

BACKGROUND OF THE INVENTION

1. Field of the Invention

The present invention relates to a connector, and more particularly to a plug connector capable of transmitting high frequency signals and facilitates soldering terminals thereof.

2. Description of Related Art

Conventional Universal Serial Bus (USB) 2.0 connectors are popular in various electronic devices. However, the USB 2.0 transmission protocol only allows a maximum transmission speed of 480 Mbps. Because electronic devices are constantly developed to increase transmission speed, the USB 2.0 transmission protocol does not meet the current transmission speed requirement of these electronic devices. Therefore, the USB Implementers Forum (USB IF) is setting up a USB 3.0 transmission protocol that may achieve a theoretical maximum transmission speed of 4.8 Gbps, almost 10 times of that of the USB 2.0 transmission protocol.

However, to implement the transmission of 4.8 Gbps, terminals of a USB 3.0 connector must be capable of transmitting high frequency signals. Transmitting high frequency signals usually encounters electromagnetic interference from nearby electronic components so that the impedance of USB 3.0 connector unstably alternates and reduces signal transmission.

To be compatible with USB connectors, a USB 3.0 connector must have rows of terminals. When the terminals are soldered with wires of a cable, the rows interfere with one another to make the soldering process difficult. Furthermore, the USB 3.0 connector has an insulative housing and a positioning bracket mounted on the insulative housing by setting hot-melt adhesive into the boundary therebetween. However, a mating boundary between the insulative housing and the positioning bracket is flat so that the hot-melt adhesive easily flows into terminal holes in the insulative housing and the positioning bracket to disadvantageously affect characteristics of the terminals and reduces signal transmission efficiency.

To overcome the shortcomings, the present invention provides a plug connector to mitigate or obviate the aforementioned problems.

SUMMARY OF THE INVENTION

The main objective of the invention is to provide a plug connector capable of transmitting high frequency signals and facilitates soldering terminals thereof.

A plug connector in accordance with the present invention has an insulative housing, a plurality of first terminals, a plurality of second terminals and a positioning bracket. The terminals are mounted in the insulative housing and each terminal has a soldering portion. The positioning bracket is mounted on the insulative housing and has a positioning protrusion having a top surface and a bottom surface respectively holding the soldering portions on two levels. The soldering portions are arranged in two levels to facilitate soldering wires to the soldering portions.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
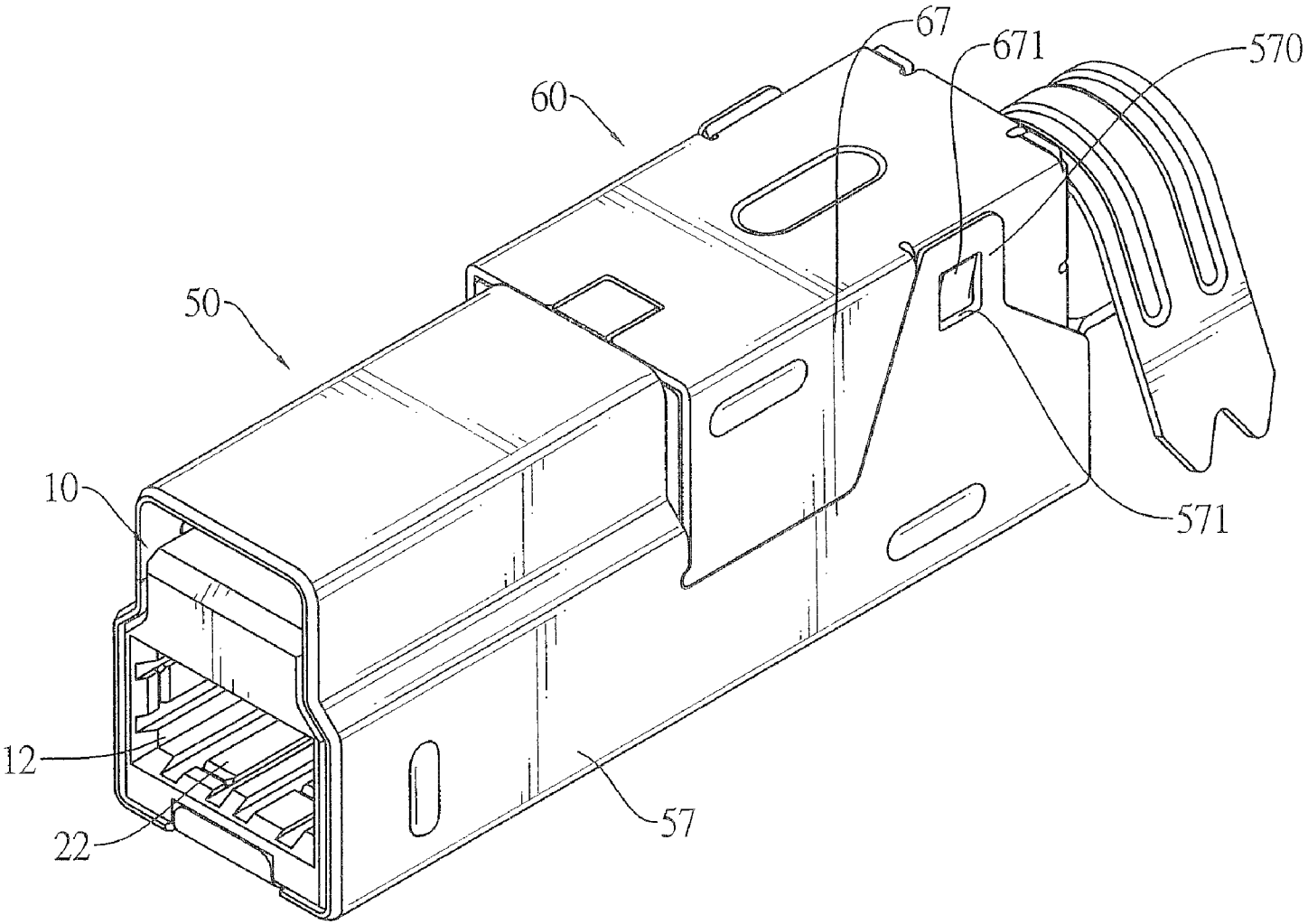
FIG. 1 is a perspective view of a plug connector in accordance with present invention.
Figure 2:
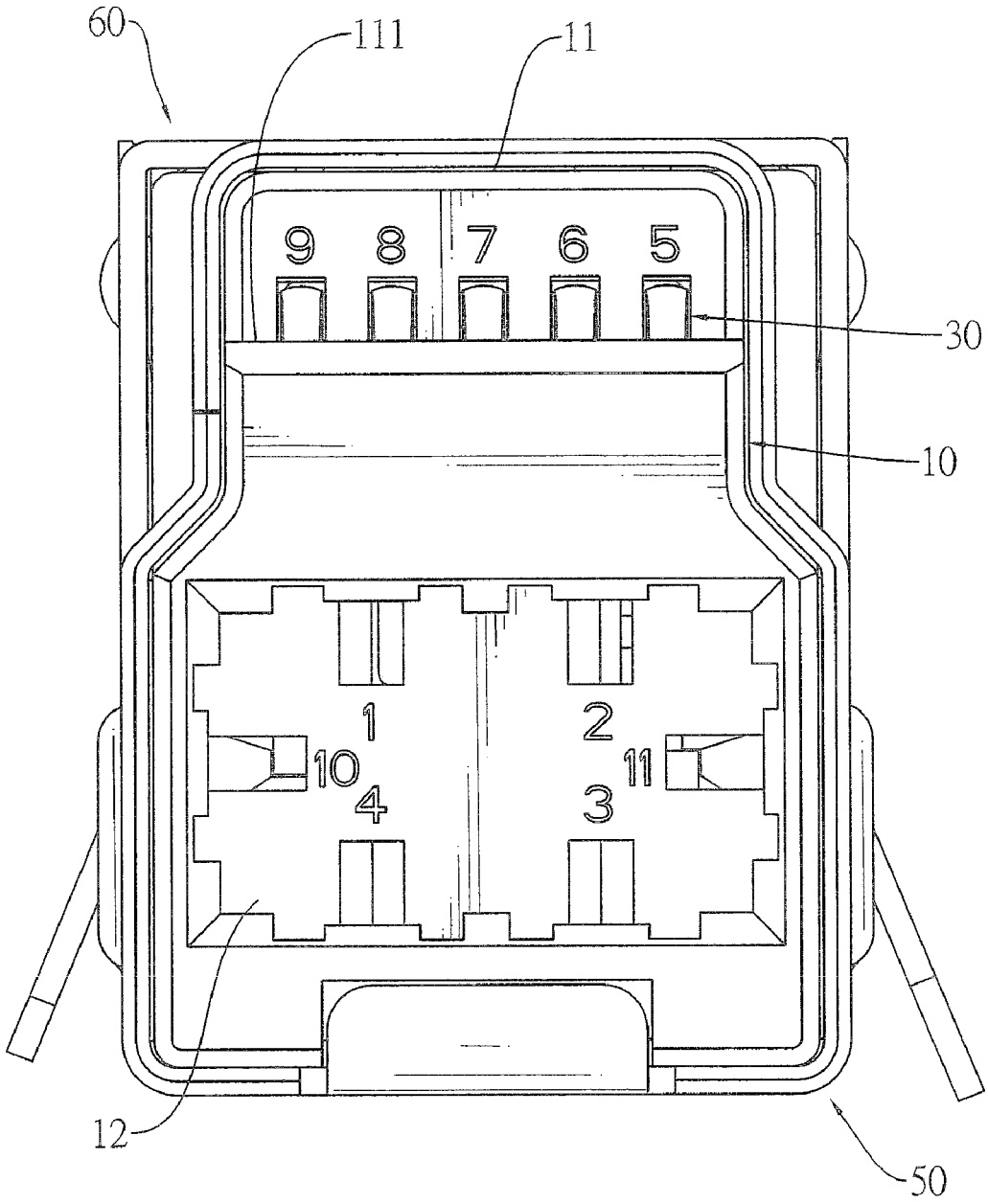
FIG. 2 is a front view of the plug connector in FIG. 1.
Figure 3:
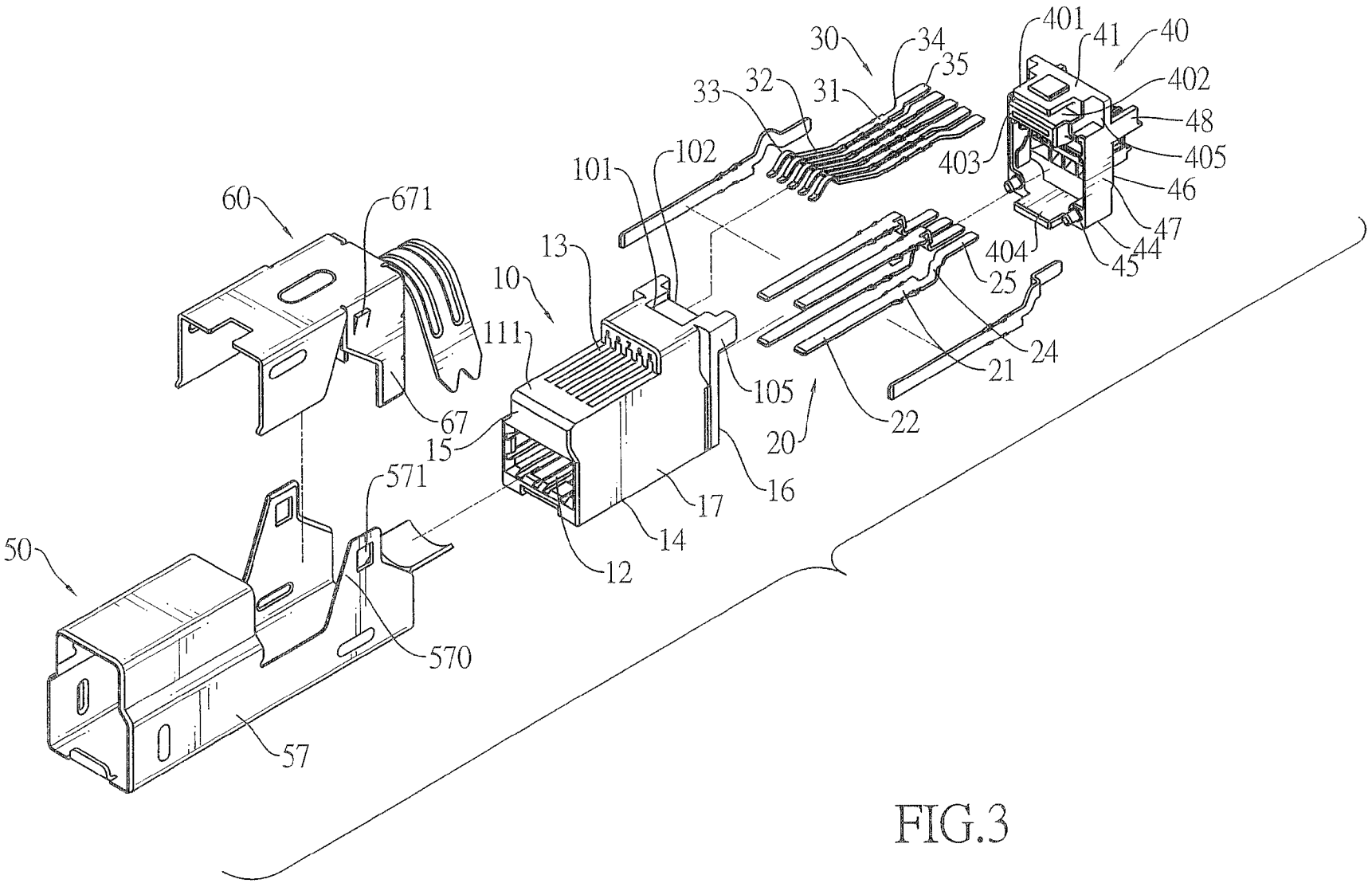
FIG. 3 is an exploded front perspective view of the plug connector in FIG. 1.
Figure 4:
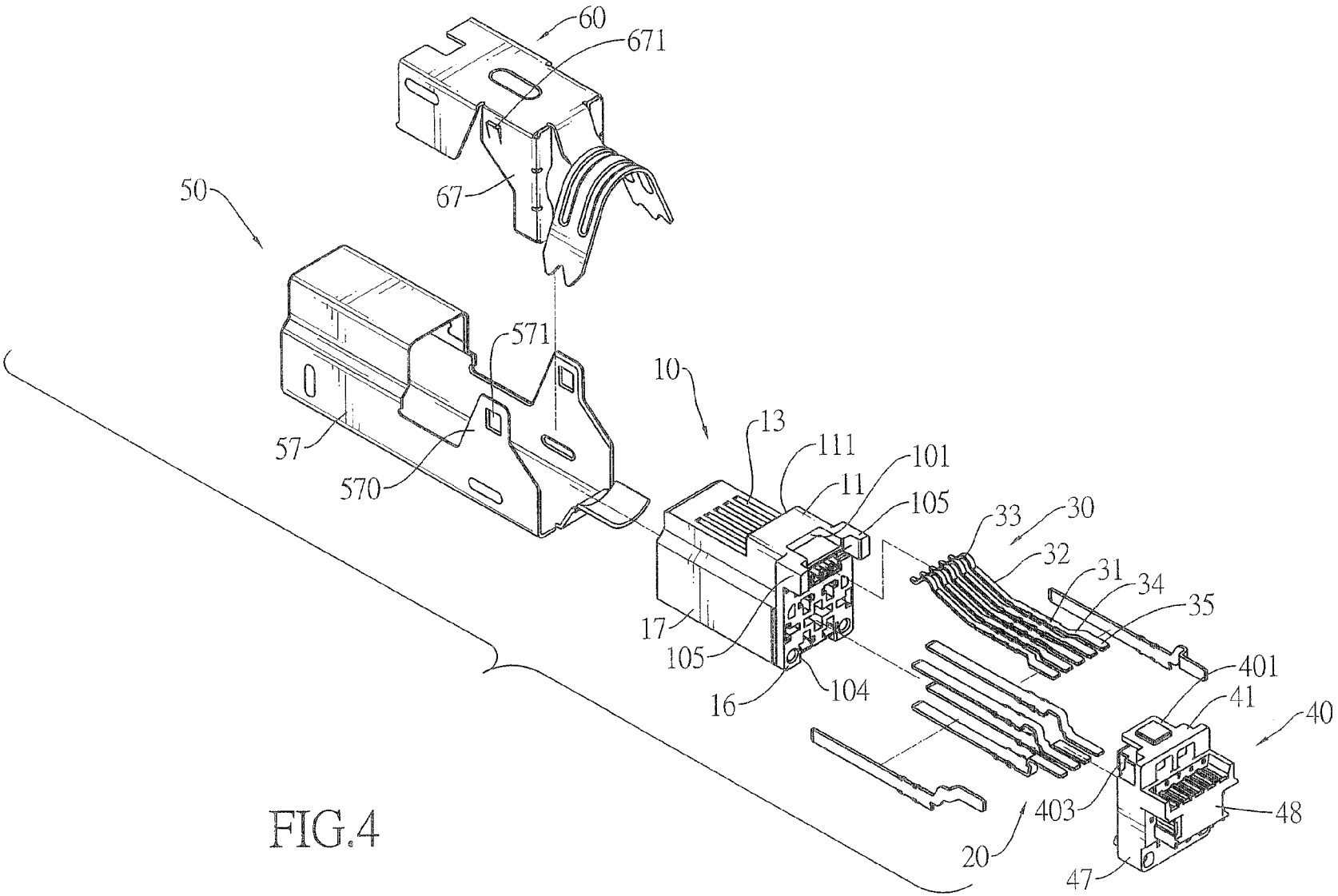
FIG. 4 is an exploded rear perspective view of the plug connector in FIG. 1.

With reference to FIGS. 1 to 4, a plug connector in accordance with the present invention may comply with the Universal Serial Bus (USB) 3.0 and 2.0 transmission protocols and comprises an insulative housing (10), a plurality of first terminals (20), a plurality of second terminals (30), a positioning bracket (40) and a metal shell assembly.

With further reference to FIGS. 7 to 10, the insulative housing (10) has a top (11), a bottom (14), a front (15), a rear (16) and two opposite sides (17) and may further have a plurality of first mounting holes (100*a*), a recessed portion (111), a plurality of mounting grooves (13), a plurality of second mounting holes (100*b*), a first socket hole (12) and a lumpy engaging portion.

The first mounting holes (100*a*) are defined in the rear (16).

The recessed portion (111) is defined on the top (11) adjacent to the front (15).

The mounting grooves (13) are defined in the recessed portion (111).

The second mounting holes (100*b*) are defined in the rear (16) and communicate respectively with the mounting grooves (13).

The first socket hole (12) is defined in the front (15), communicates with the first mounting holes (100*a*) and has an inner top surface and an inner bottom surface.

The lumpy engaging portion is formed on the rear (16) and may have a plurality of engaging protrusions (102, 105) and a plurality of engaging recesses (101, 103, 104).

Figure 11:
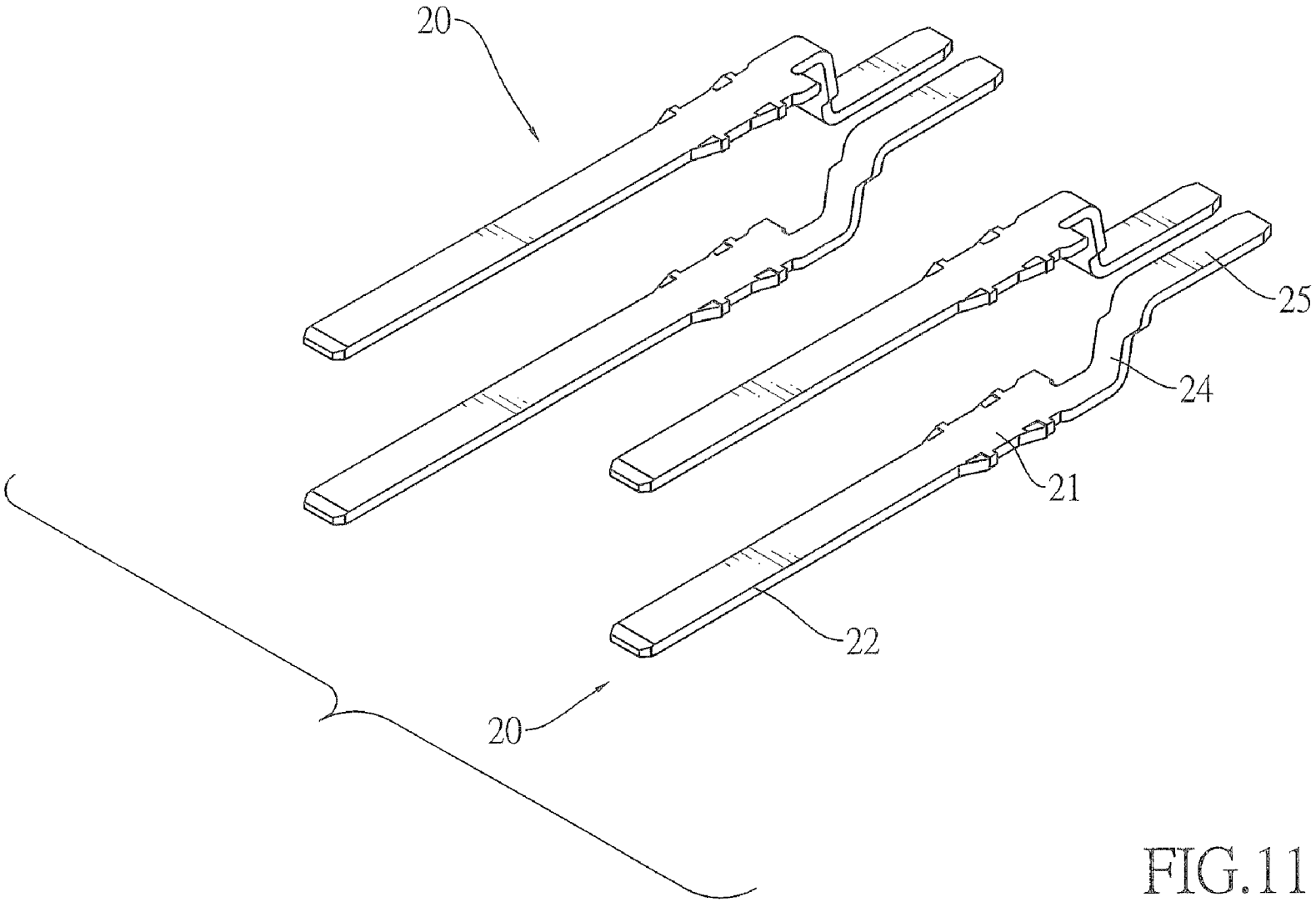
FIG. 11 is an exploded perspective view of the first terminals of the plug connector in FIG. 3.

With further reference to FIG. 11, the first terminals (20) may comply with the USB 2.0 transmission protocol, may be four first terminals (20), are mounted in the insulative housing (10) and may be mounted respectively through and correspond respectively to the first mounting holes (100*a*). Each first terminal (20) has a mounting section (21), a contacting section (22), a bent section (24) and a soldering section (25).

The mounting section (21) is mounted in the insulative housing (10), may be mounted in a corresponding first mounting hole (100*a*).

The contacting section (22) is formed on and protrudes forwards from the mounting section (21) and may be mounted in the first socket hole (12) of the insulative housing (10). The contacting sections (22) may be two pairs, one pair is mounted on the inner top surface of the first socket hole (12) and the other is mounted on the inner bottom surface of the first socket hole (12). The contacting section (22) may contact a terminal of a corresponding receptacle connector.

The bent section (24) is formed on and perpendicularly protrudes upwards or downwards from the mounting section (21) opposite to the contacting section (22).

The soldering section (25) is formed on and protrudes perpendicularly backwards from the bent section (24) and is substantially horizontal relative to the insulative housing (10). The soldering sections (25) of all the first terminals (20) are arranged in a first level relative to the insulative housing (10) by the bent sections (24) and are flush with one another.

Figure 12:
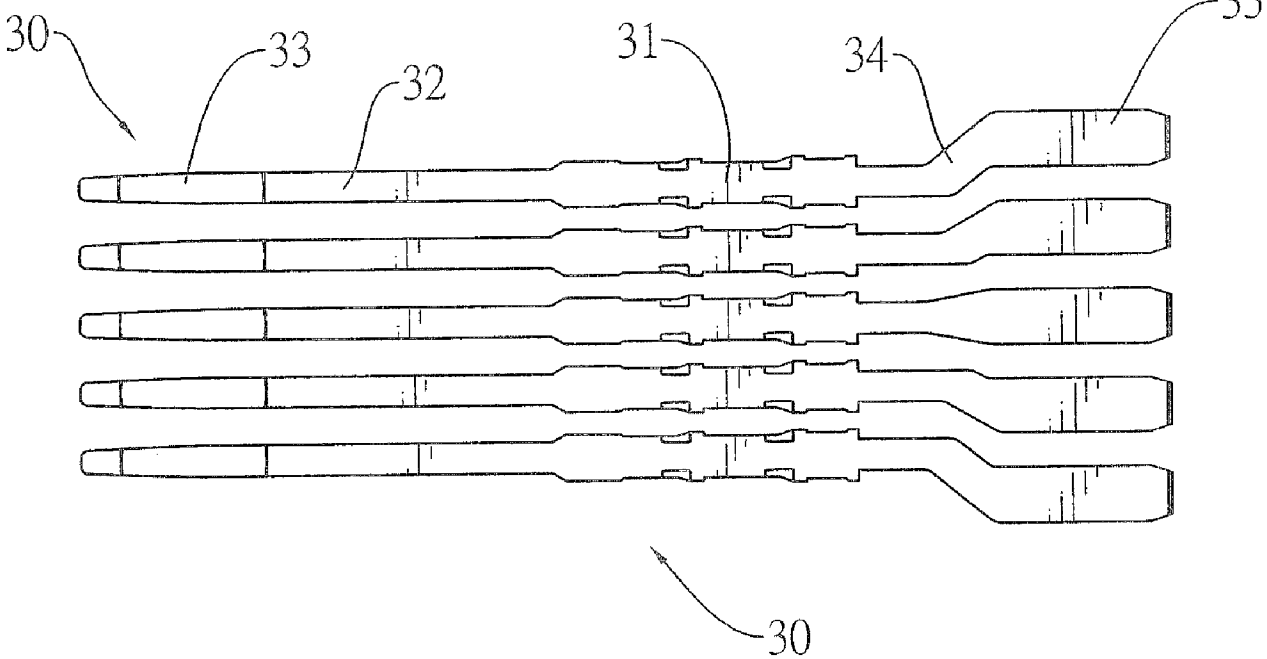
FIG. 12 is a top view of the second terminals of the plug connector in FIG. 3.

With further reference to FIG. 12, the second terminals (30) may comply with the USB 3.0 transmission protocol, may be odd, five second terminals (30) may be implemented, and the second terminals (30) are mounted in the insulative housing (10) and may be mounted respectively through and correspond respectively to the second mounting terminal holes (100*b*) and the mounting grooves (13). Each second terminal (30) has a mounting segment (31), a resilient segment (32), a contacting segment (33) and a soldering segment (35).

The mounting segment (31) is mounted in the insulative housing (10) and may be mounted in a corresponding second mounting hole (100*b*).

The resilient segment (32) is formed on and protrudes forwards from the mounting segment (31) and may be mounted in a corresponding mounting groove (13).

The contacting segment (33) is formed on and protrudes forwards from the resilient segment (32) and may be mounted in the corresponding mounting groove (13). The contacting segment (33) may contact a terminal of a corresponding receptacle connector.

The soldering segment (35) is connected to the mounting segment (31). The soldering segments (35) of all the second terminals (30) are arranged in a second level relative to the insulative housing (10) and are flush with one another.

When five second terminals (30) are implemented, each second terminal (30) except a central one of the second terminals (30) further has an inclined segment (34). The inclined segment (34) is formed on and protrudes obliquely and horizontally backwards from the mounting segment (31) away from the central second terminal (30) and connects the soldering segment (35) to the mounting segment (31) so that the soldering segment (35) is formed on and protrudes backwards from the inclined segment (34). The inclined segments (34) are arranged in a sector-shaped arrangement so that an interval between adjacent two soldering segments (35) are increased to facilitate soldering and prevent short circuiting problems.

Figure 5:
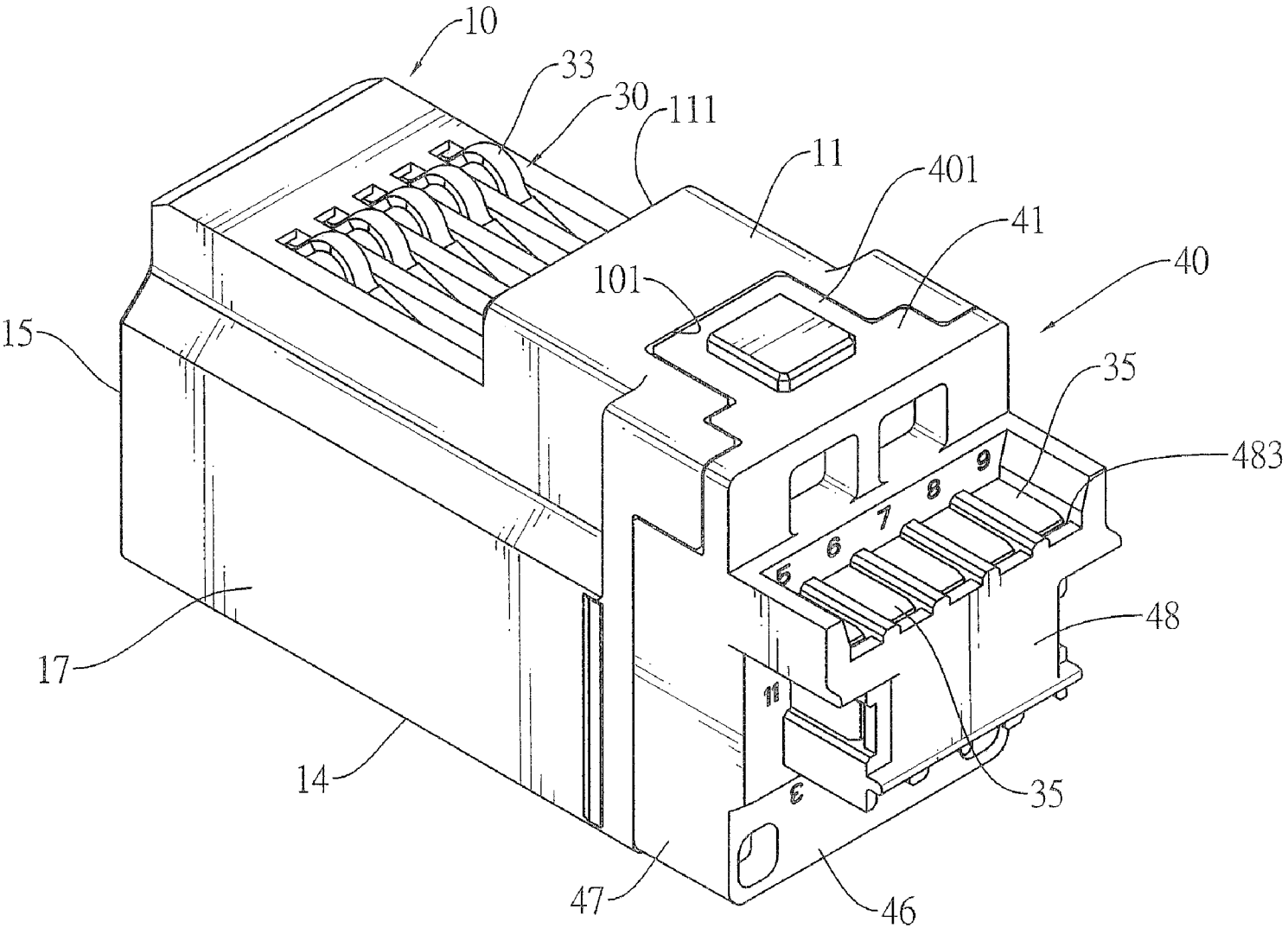
FIG. 5 is a rear perspective view of the plug connector in FIG. 1 without a metal shell.
Figure 6:
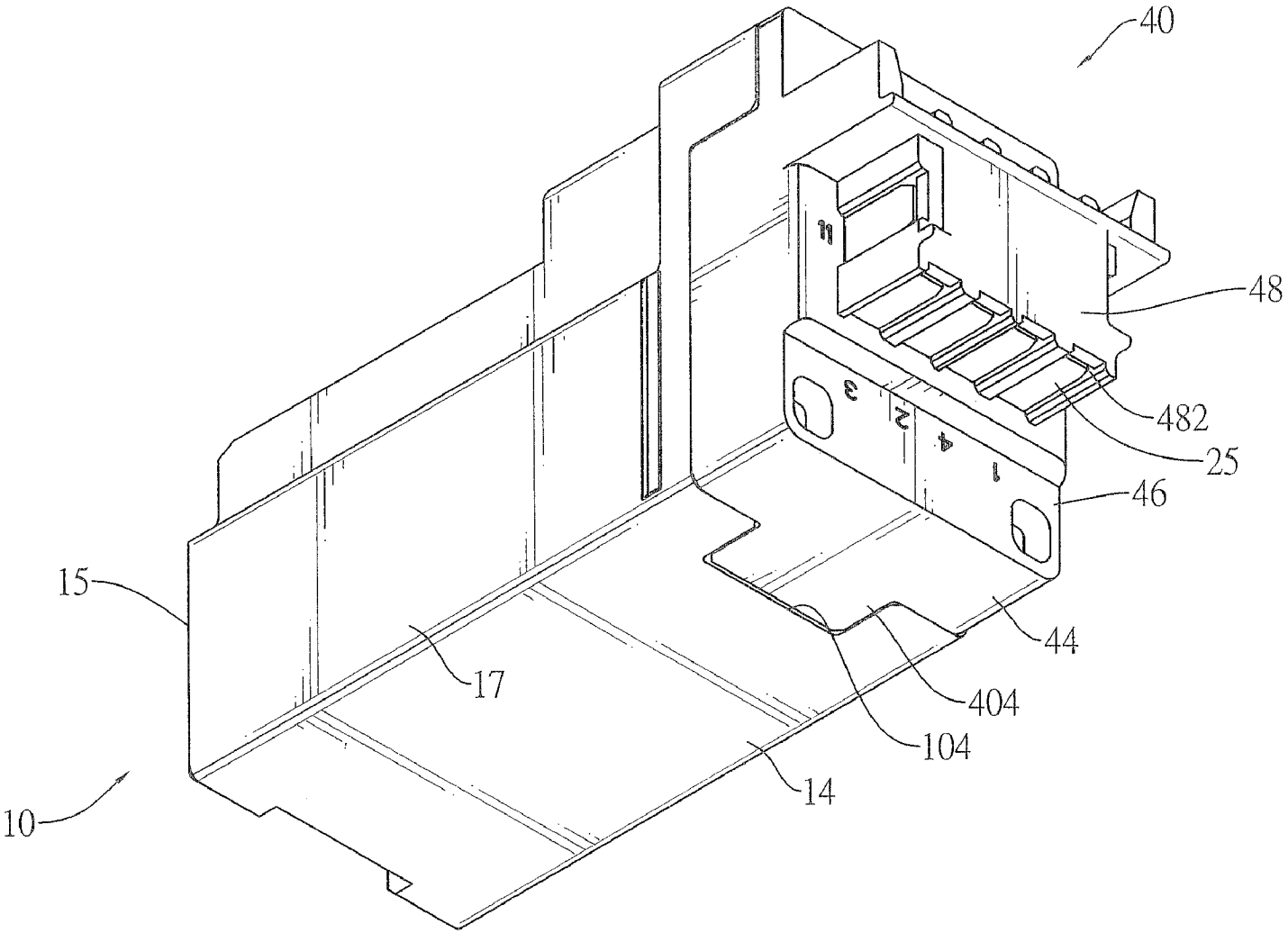
FIG. 6 is a bottom perspective view of the plug connector in FIG. 5 without the metal shell.
Figure 7:
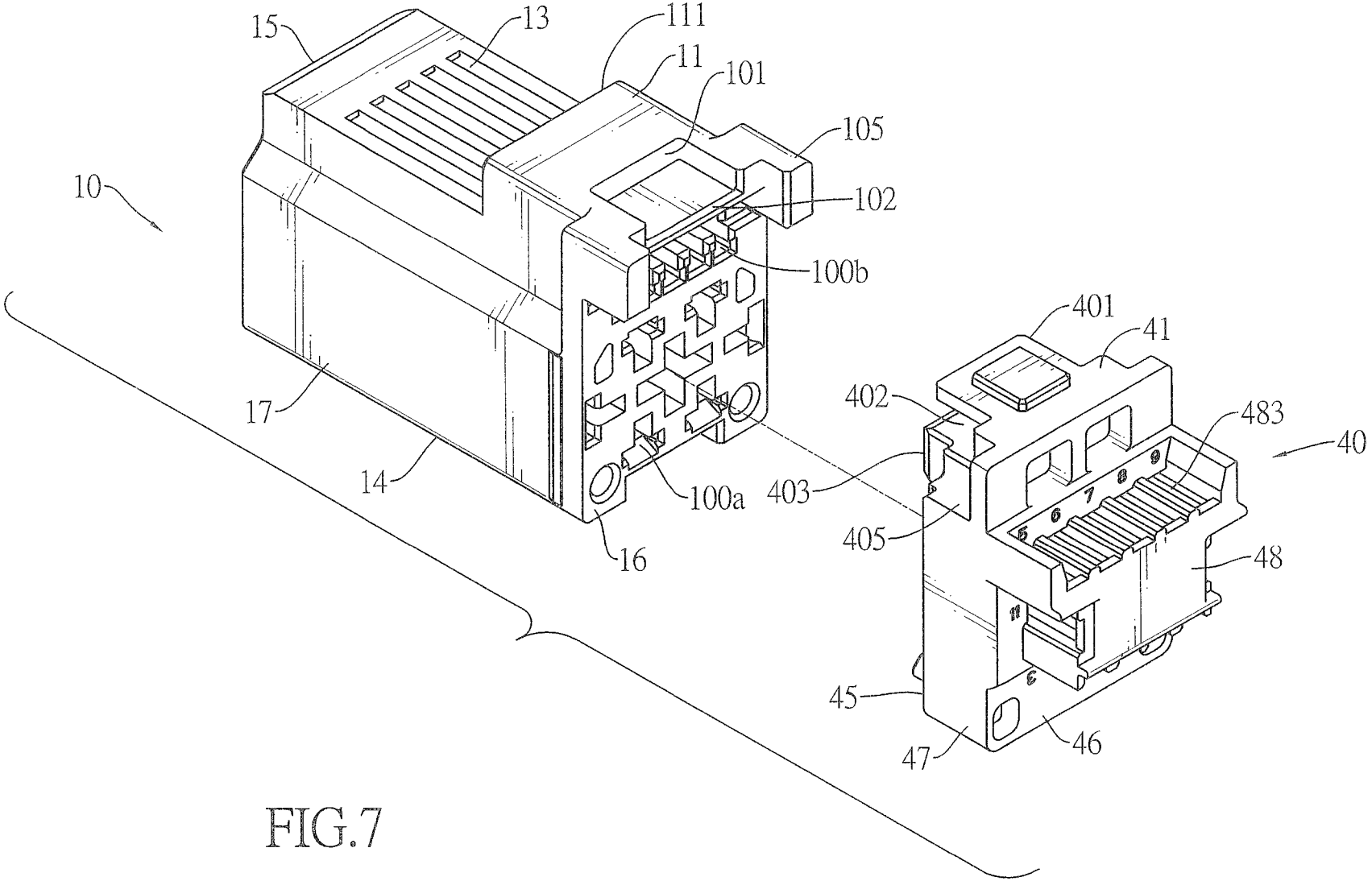
FIG. 7 is an exploded rear perspective view of the insulative housing and the positioning bracket of the plug connector in FIG. 5.
Figure 8:
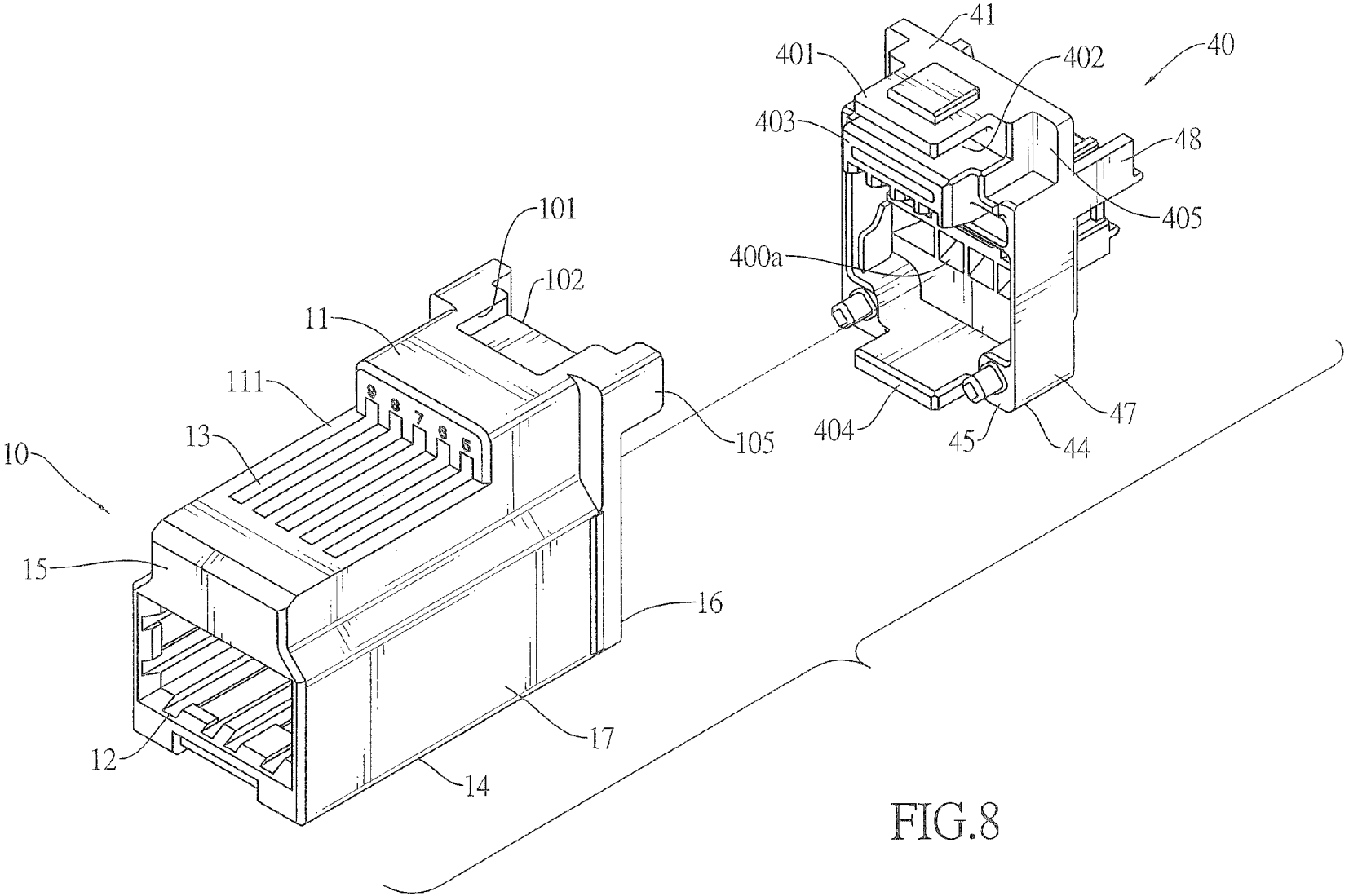
FIG. 8 is an exploded front perspective view of the insulative housing and the positioning bracket of the plug connector in FIG. 7.

With further reference to FIGS. 5 and 6, the positioning bracket (40) is mounted on the rear (16) of the insulative housing (10), holds the first and second terminals (20, 30) and has a top end (41), a bottom (44), a front end (45), a rear end (46), two opposite sides (47) and a positioning protrusion (48) and may further have a plurality of first fastening holes (400*a*), a plurality of second fastening holes (400*b*) and a lumpy engaging segment.

The positioning protrusion (48) is formed on and protrudes backwards from the rear end (46), has a top surface and a bottom surface and may further have a plurality of first positioning slots (482) and a plurality of second positioning slots (483). The top surface holds the soldering segments (35) of the second terminals (30). The bottom surface holds the soldering sections (25) of the first terminals (20). The first positioning slots (482) are defined in the bottom surface and respectively hold the soldering sections (25) of the first terminals (20) in the first level. The second positioning slots (483) are defined in the top surface and respectively hold the soldering segment (35) of the second terminals (30) in the second level. The first and second slots (482, 483) ensure adjacent soldering sections and segments (25, 35) are held at an interval to prevent the soldering sections and segments (25, 35) from being inadvertently soldered together to cause short circuiting.

The first fastening holes (400*a*) are defined through the positioning bracket (40) and communicate respectively with the first positioning slots (482).

The second fastening holes (400*b*) are defined through the positioning bracket (40) and communicate respectively with the second positioning slots (483).

Figure 9:
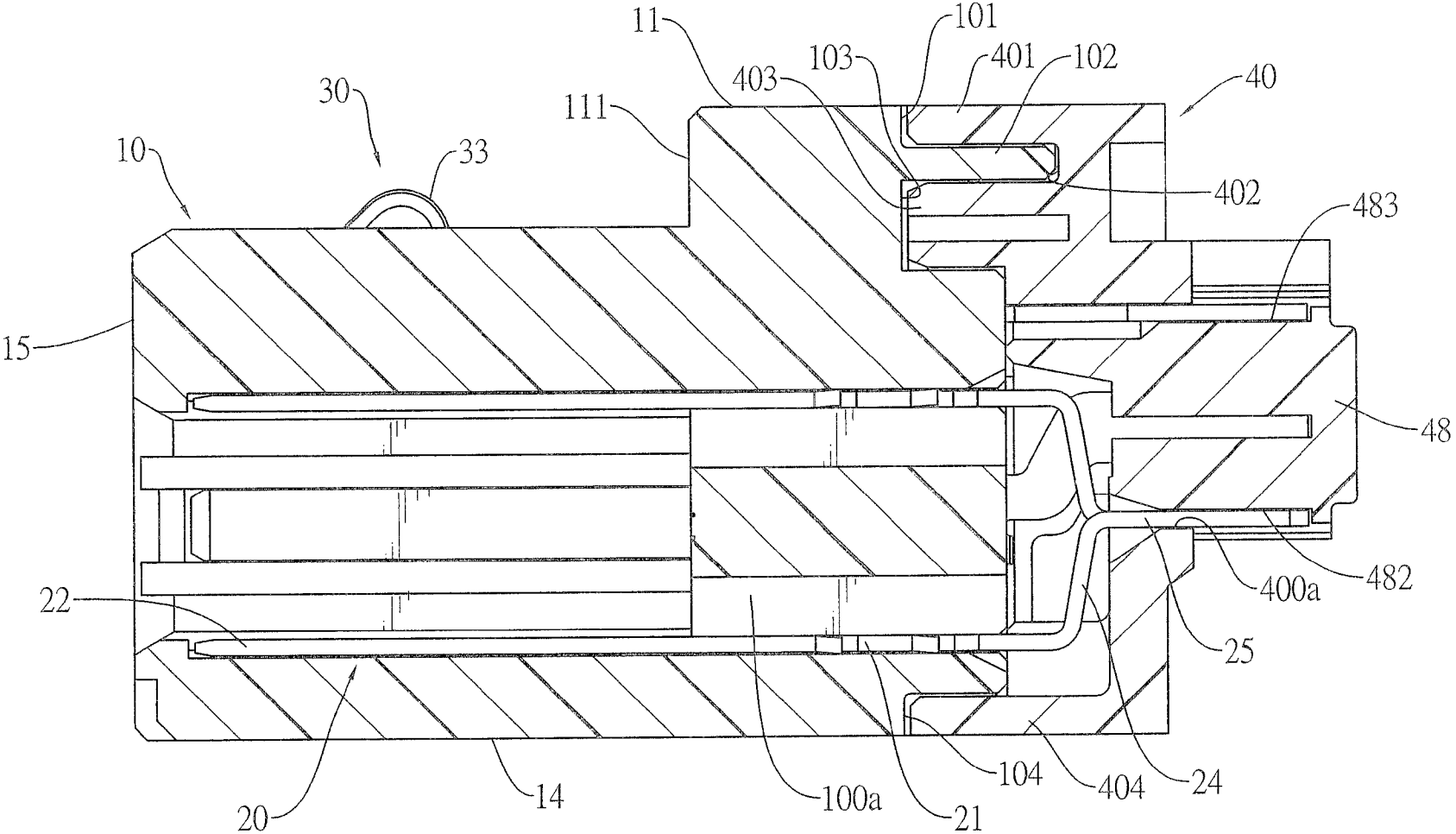
FIG. 9 is a side view in partial section of the plug connector in FIG. 5 without the metal shell.
Figure 10:
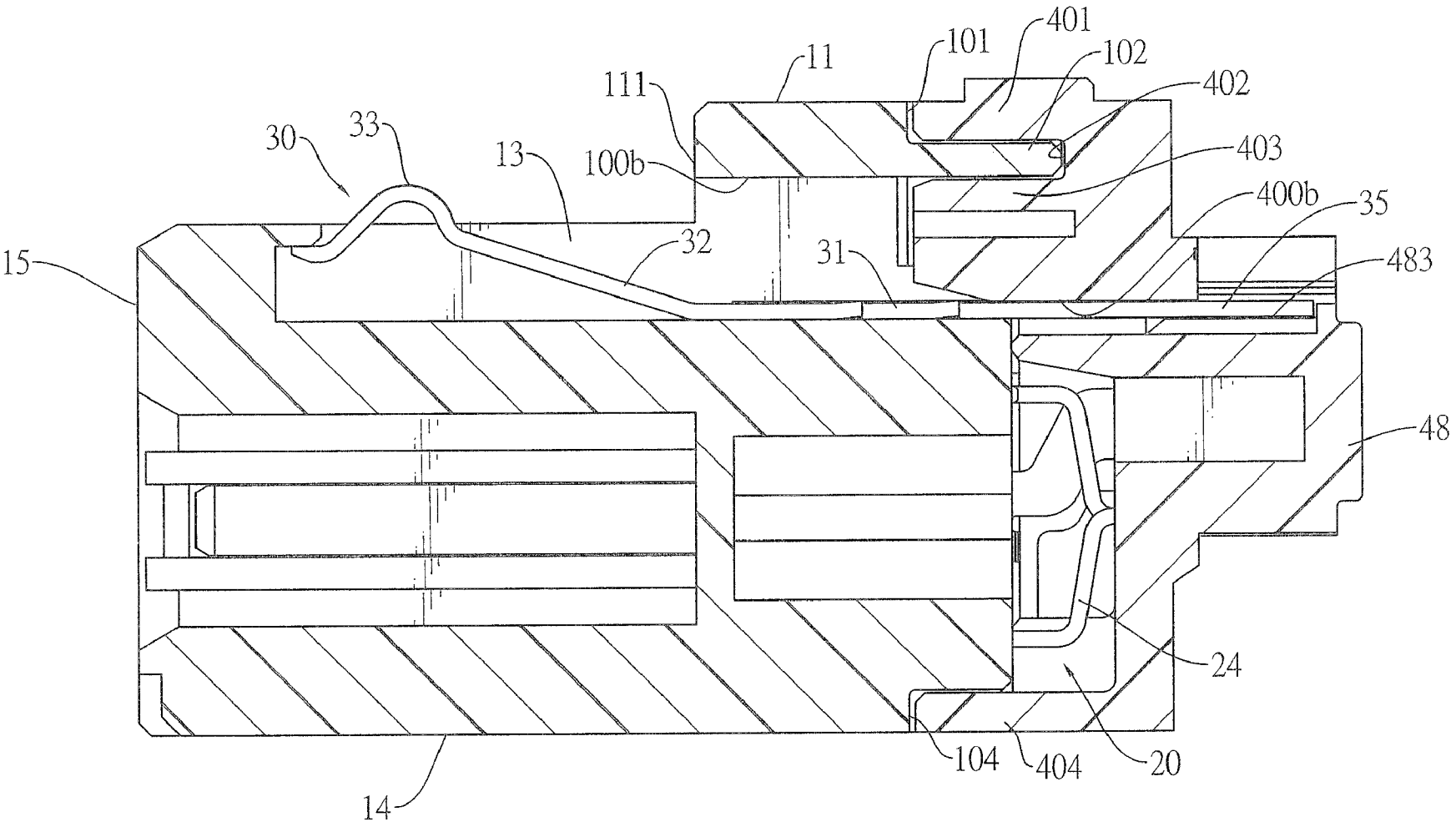
FIG. 10 is another side view in partial section of the plug connector in FIG. 5 without the metal shell.

The lumpy engaging segment is formed on the front end (45) and is engaged with the lumpy engaging portion of the insulative housing (10) with a boundary between the engaged surface and segment being zigzag, as shown in FIG. 9. The lumpy engaging segment may have a plurality of engaging protrusions (401, 403, 404) and a plurality of engaging recesses (402, 405). The engaging protrusions (401, 403, 404) are engaged respectively with the engaging recesses (101, 103, 104) of the insulative housing (10). The engaging recesses (402, 405) are engaged respectively with the engaging protrusions (102, 105) of the insulative housing (10). When hot-melt adhesive is applied to combine the insulative housing (10) and the positioning bracket (40), the zigzag boundary between the engaged surface and the segment creates a flow path of the hot-melt adhesive and prevents the hot-melt adhesive from further flowing into the first and second mounting holes (100*a*, 100*b*) and the first and second fastening holes (400*a*, 400*b*).

The metal shell assembly covers the insulative housing (10) and the positioning bracket (40) and may have a front metal shell (50) and a rear metal shell (60).

The front metal shell (50) covers the insulative housing (10) and the positioning bracket (40), cooperates with the recessed portion (111) to define a second socket hole and has two opposite side plates (57). Each side plate (57) has a buckling portion (570) protruding from the side plate (57) and having a buckling hole (571) defined through the buckling portion (570).

The rear metal shell (60) covers the insulative housing (10) and the positioning bracket (40), is engaged with the front metal shell (60) and has two opposite side plates (670). Each side plate (67) has a buckling tab (67) engaged with one buckling hole (571) of the front metal shell (50).

The present invention has following advantages.

The contacting sections and segments (22, 33) of the first and second terminals (20, 30) are arranged in three levels. However, the soldering sections and segments (25, 35) are simplified in two levels respectively at the top and bottom surfaces of the positioning bracket (48) and are flush with one another. When wires of a cable are soldered on the soldering sections and segments (25, 35), the wires are stripped a same length and soldered along segments (25, 35) conveniently. Furthermore, the length of stripped wires are the same so transmitting high frequency characteristics are identical to keep impedance of the plug connector stable and facilitate signal transmission.

The intervals between adjacent soldering segments (35) are enlarged to facilitate soldering the wires and prevent short circuiting.

The first terminals (20) have substantially identical shapes and may be manufactured by a singular mold.

The lumpy engaging portion and segment prevent the hot-melt adhesive from overflowing into the mounting and fastening holes (100*a*, 100*b*, 400*a*, 400*b*) and affecting signal transmission characteristics. Therefore, the plug connector has a stable impedance for signal transmission.

Even though numerous characteristics and advantages of the present invention have been set forth in the foregoing description, together with details of the structure and function of the invention, the disclosure is illustrative only Changes may be made in the details, especially in matters of shape, size, and arrangement of parts within the principles of the invention to the full extent indicated by the broad general meaning of the terms in which the appended claims are expressed.

What is claimed is:

1. A plug connector comprising:

an insulative housing having a top, a bottom, a front, a rear and two opposite sides;

a plurality of first terminals mounted in the insulative housing and each first terminal having a mounting section mounted in the insulative housing;

a contacting section formed on and protruding from the mounting section;

a bent section formed on and protruding perpendicularly from the mounting section opposite to the contacting section; and a soldering section formed on and protruding perpendicularly backwards from the bent section, being substantially horizontal relative to the insulative housing and the soldering sections of all the first terminals arranged in a first level relative to the insulative housing and being flush with one another;

a plurality of second terminals mounted in the insulative housing and having a mounting segment mounted in the insulative housing;

a resilient segment formed on and protruding forwards from the mounting segment;

a contacting segment formed on and protruding forwards from the resilient segment; and a soldering segment connected to the mounting segment and the soldering segments of all the second terminals arranged in a second level relative to the insulative housing and being flush with one another;

a positioning bracket mounted on the rear of the insulative housing and having a top end, a bottom, a front end, a rear end, two opposite sides and a positioning protrusion formed on and protruding backwards from the rear end and having a top surface holding the soldering segments of the second terminals; and a bottom surface holding the soldering sections of the first terminals; and a metal shell assembly covering the insulative housing and the positioning bracket.

2. The plug connector as claimed in claim 1, wherein the second terminals are odd and each second terminal except a central one of the second terminals further has an inclined segment formed on and protruding obliquely and horizontally backwards from the mounting segment away from the central second terminal and connecting the soldering segment to the mounting segment so that the soldering segment is formed on and protrudes backwards from the inclined segment; and all of the inclined segments are arranged in a sector-shaped arrangement.

3. The plug connector as claimed in claim 2, wherein the insulative housing further has a lumpy engaging portion formed on the rear;

the positioning bracket further has a lumpy engaging segment formed on the front end and engaged with the lumpy engaging portion of the insulative housing with a boundary between the lumpy engaging portion and segment being zigzag.

4. The plug connector as claimed in claim 3, wherein the lumpy engaging portion has a plurality of engaging protrusions and a plurality of engaging recesses; and the lump engaging segment has a plurality of engaging protrusions engaged respectively with the engaging recesses of the insulative housing; and a plurality of engaging recesses engaged respectively with the engaging protrusions of the insulative housing.

5. The plug connector as claimed in claim 4, wherein the insulative housing further has a plurality of first mounting holes defined in the rear;

a recessed portion defined in the top adjacent to the front;

a plurality of mounting grooves defined in the recessed portion;

a plurality of second mounting holes defined in the rear and communicating respectively with the mounting grooves; and a first socket hole defined in the front and communicating with the first mounting holes;

the mounting section of each first terminal is mounted in one first mounting hole and the contacting section of each first terminal is mounted in the first socket hole;

the mounting segment of each second terminal is mounted in one second mounting hole and the resilient and contacting segment of each second terminal is mounted in one mounting groove.

6. The plug connector as claimed in claim 5, wherein the positioning protrusion further has a plurality of first positioning slots defined in the bottom surface and respectively holding the soldering sections of the first terminals in the first level; and a plurality of second positioning slots defined in the top surface and respectively holding the soldering segment of the second terminals in the second level.

7. The plug connector as claimed in claim 6, wherein the terminal protrusion bracket further has a plurality of first fastening holes defined through the positioning bracket, communicating respectively with the first positioning slots and respectively holding the soldering sections of the first terminals; and a plurality of second fastening holes defined through the positioning bracket, communicating respectively with the second positioning slots and respectively holding the soldering segments of the second terminals.

8. The plug connector as claimed in claim 7, wherein the metal shell assembly has a front metal shell covering the insulative housing and the positioning bracket, cooperating with the recessed portion to define a second socket hole and having two opposite side plates; and a rear metal shell covering the insulative housing and the positioning bracket, engaged with the front metal shell and having two opposite side plates.

9. The plug connector as claimed in claim 8, wherein each side plate of the front metal shell has a buckling hole; and each side plate of the rear metal shell has a buckling tab engaged with one buckling hole.

10. The plug connector as claimed in claim 9, wherein the first terminals comply with the USB 2.0 transmission protocol.

11. The plug connector as claimed in claim 10, wherein the second terminals comply with the USB 3.0 transmission protocol.

* * * * *